US007855804B2

(12) United States Patent
Tanjima et al.

(10) Patent No.: US 7,855,804 B2
(45) Date of Patent: Dec. 21, 2010

(54) TAPE CREATING APPARATUS

(75) Inventors: Naoki Tanjima, Nagoya (JP); Jun Itakura, Nagoya (JP); Yuichiro Suzuki, Okazaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1660 days.

(21) Appl. No.: 10/919,336

(22) Filed: Aug. 17, 2004

(65) Prior Publication Data

US 2005/0069368 A1 Mar. 31, 2005

(30) Foreign Application Priority Data

Sep. 29, 2003 (JP) ..... 2003-337811

(51) Int. Cl.
*B41J 11/66* (2006.01)

(52) U.S. Cl. ..... 358/1.18; 358/1.15; 358/1.1; 400/76; 400/621; 400/613; 400/615; 400/615.2; 347/104

(58) Field of Classification Search ..... None
See application file for complete search history.

(56) References Cited

U.S. PATENT DOCUMENTS 4,004,362 A * 1/1977 Barbieri ..... 40/316
5,374,130 A * 12/1994 Hirono ..... 400/68
5,931,587 A * 8/1999 Hayama ..... 400/76
6,050,734 A * 4/2000 Watanabe et al. ..... 400/615.2
6,371,670 B1 * 4/2002 Kojo ..... 400/120.01
6,457,165 B1 * 9/2002 Ishikawa et al. ..... 716/12
2002/0161535 A1 * 10/2002 Kawakita et al. ..... 702/42
2004/0033099 A1 * 2/2004 Van Bever ..... 400/615.2
2006/0263132 A1 * 11/2006 Yamamoto et al. ..... 400/62

FOREIGN PATENT DOCUMENTS

CN 1255893 A 6/2000
EP 0 624 855 A1 11/1994
EP 624855 A1 * 11/1994
JP 6-247431 9/1994
JP A 2003-170628 6/2003

* cited by examiner

*Primary Examiner*—Edward L Coles
*Assistant Examiner*—Pawandeep S Dhingra
(74) *Attorney, Agent, or Firm*—Oliff & Berridge, PLC

(57) ABSTRACT

A tape creating apparatus, including a printing device that prints characters on label tape that includes a winding margin portion that is wound around a periphery of a cylindrical member and a flag portion that is uniformly formed with the winding margin portion, wherein the characters are printed on the flag portion, a first input device for inputting a diameter of the cylindrical member, and a first setting device for setting a length of the flag portion and a length of the winding margin portion on the basis of the diameter of the cylindrical member as input by the first input device.

16 Claims, 20 Drawing Sheets

FIG. 10

TABLE 1

| DIAMETER OF CORD R | LENGTH OF FLAG PORTION L1 |
|---|---|
| NOT MORE THAN 2mm | 20mm |
| LARGER THAN 2mm BUT NOT MORE THAN 4mm | 30mm |
| LARGER THAN 4mm BUT NOT MORE THAN 6mm | 40mm |
| LARGER THAN 6mm BUT NOT MORE THAN 8mm | 60mm |
| LARGER THAN 8mm BUT NOT MORE THAN 10mm | 80mm |
| LARGER THAN 10mm BUT NOT MORE THAN 12mm | 120mm |
| LARGER THAN 12mm | 160mm |

NUMBER OF CORDS N=1

FIG. 11

TABLE 2

| NUMBER OF CORDS N / DIAMETER OF CORD R | TWO | THREE | FOUR | FIVE | ・・・・・ |
|---|---|---|---|---|---|
| NOT MORE THAN 2mm | 30mm | 40mm | 60mm | 80mm | ・・・・・ |
| LARGER THAN 2mm BUT NOT MORE THAN 4mm | 40mm | 60mm | 80mm | 120mm | ・・・・・ |
| LARGER THAN 4mm BUT NOT MORE THAN 6mm | 60mm | 80mm | 120mm | 160mm | ・・・・・ |
| LARGER THAN 6mm BUT NOT MORE THAN 8mm | 80mm | 120mm | 160mm | 160mm | ・・・・・ |
| LARGER THAN 8mm BUT NOT MORE THAN 10mm | 120mm | 160mm | 160mm | 160mm | ・・・・・ |
| LARGER THAN 10mm BUT NOT MORE THAN 12mm | 160mm | 160mm | 160mm | 160mm | ・・・・・ |
| LARGER THAN 12mm | 160mm | 160mm | 160mm | 160mm | ・・・・・ |

FIG. 12

TABLE 3

| DIAMETER OF CORD R | CHARACTER SIZE S | NUMBER OF PRINTED DOTS |
|---|---|---|
| NOT MORE THAN 2mm | 1 | 16×16 |
| LARGER THAN 2mm BUT NOT MORE THAN 4mm | 2 | 24×24 |
| LARGER THAN 4mm BUT NOT MORE THAN 6mm | 3 | 32×32 |
| LARGER THAN 6mm BUT NOT MORE THAN 8mm | 4 | 48×48 |
| LARGER THAN 8mm BUT NOT MORE THAN 10mm | 5 | 64×64 |
| LARGER THAN 10mm BUT NOT MORE THAN 12mm | 6 | 96×96 |
| LARGER THAN 12mm | 7 | 128×128 |

NUMBER OF CORDS N=1

FIG. 13

TABLE 4

| NUMBER OF CORDS N / DIAMETER OF CORD R | TWO | THREE | FOUR | FIVE | ····· |
|---|---|---|---|---|---|
| NOT MORE THAN 2mm | 2 | 3 | 4 | 5 | ····· |
| LARGER THAN 2mm BUT NOT MORE THAN 4mm | 3 | 4 | 5 | 6 | ····· |
| LARGER THAN 4mm BUT NOT MORE THAN 6mm | 4 | 5 | 6 | 7 | ····· |
| LARGER THAN 6mm BUT NOT MORE THAN 8mm | 5 | 6 | 7 | 7 | ····· |
| LARGER THAN 8mm BUT NOT MORE THAN 10mm | 6 | 7 | 7 | 7 | ····· |
| LARGER THAN 10mm BUT NOT MORE THAN 12mm | 7 | 7 | 7 | 7 | ····· |
| LARGER THAN 12mm | 7 | 7 | 7 | 7 | ····· |

FIG. 14

EQUATION 1

LENGTH OF WINDING MARGIN L2=
(DIAMETER OF CORD R+THICKNESS OF TAPE D × 2) × CIRCULAR CONSTANT $\pi$

FIG. 15

TABLE 5

| NUMBER OF CORDS N / DIAMETER OF CORD R | TWO | THREE | FOUR | FIVE | ..... |
|---|---|---|---|---|---|
| NOT MORE THAN 2mm | 11mm | 13mm | 15mm | 17mm | ..... |
| LARGER THAN 2mm BUT NOT MORE THAN 4mm | 21mm | 25mm | 29mm | 33mm | ..... |
| LARGER THAN 4mm BUT NOT MORE THAN 6mm | 31mm | 37mm | 43mm | 49mm | ..... |
| LARGER THAN 6mm BUT NOT MORE THAN 8mm | 42mm | 50mm | 58mm | 66mm | ..... |
| LARGER THAN 8mm BUT NOT MORE THAN 10mm | 52mm | 62mm | 72mm | 82mm | ..... |
| LARGER THAN 10mm BUT NOT MORE THAN 12mm | 62mm | 74mm | 86mm | 98mm | ..... |
| ..... | ..... | ..... | ..... | ..... | ..... |

TAPE CREATING APPARATUS

CROSS-REFERENCE TO RELATED APPLICATION

This application claims priority from JP 2003-337811, filed Sep. 29, 2003, the entire disclosure of which is hereby incorporated by reference herein in its entirety.

BACKGROUND OF THE INVENTION

1. Field of Invention

The invention relates to a tape creating apparatus that creates label tapes.

2. Description of Related Art

Japanese Patent Laid-Open Publication No. 6-247431 (1994), pp. 4-5, FIG. 7, discloses a conventionally known label creating apparatus that is used to create labels that are wound around power cords, for example. The labels are used to identify the cords and are created using the label creating apparatus.

In this label creating apparatus, labels are created by setting required winding margin lengths in correspondence with a thicknesses of the cords and printing characters onto both surfaces of the set winding margins. Identification of the cords can be easily performed when winding and adhering these labels to the cords because the characters on both surfaces of the set winding margins discriminate between various types of cords.

SUMMARY OF THE INVENTION

However, while lengths of winding margin portions are set in correspondence with the thicknesses of the cords in conventional label creating apparatuses, sizes of characters to be printed and lengths of printing portions located on both sides of the winding margin portions are not set in correspondence with the thickness of the cords. The winding margin portions were separately set by an operator or were set on the basis of preliminarily determined fixed values. However, when performing a setting on the basis of preliminarily determined fixed values, the size of the characters or the lengths of the printing portions are always the same irrespective of the thickness of the cords. The balance of size with respect to the cords or winding margin portions thus became worse, and discrimination between the types of cords needed to be made on the basis of printed characters alone.

Moreover, when the operator separately performs a setting, the operator needed to perform an input upon determining suitable sizes of characters or lengths of printing portions, which made operations troublesome.

The invention thus provides, among other things, a tape creating apparatus capable of creating label tapes that are easily visible corresponding to a thickness of cords and with which types of cords can be easily discriminated through extremely simple operations. This occurs because it is possible to set suitable values for the sizes or lengths on the basis of input diameters of cords while the operator does not need to set character sizes for printing or lengths of flag portions on his or her own.

To achieve the foregoing, according to one exemplary aspect of the invention, there is provided a tape creating apparatus that includes a printing means that prints characters on a label tape that includes a winding margin portion that is wound around a periphery of a cylindrical member and a flag portion that is uniformly formed with the winding margin portion, wherein the characters are printed on the flag portion, a first input means for inputting a diameter of the cylindrical member, and a first setting means for setting a length of the flag portion and a length of the winding margin portion on the basis of the diameter of the cylindrical member as input by the first input means.

According to another exemplary aspect of the invention, there is provided a tape creating apparatus that includes a printing means that prints characters on a label tape that includes a winding margin portion that is wound around a periphery of a cylindrical member and a flag portion that is uniformly formed with the winding margin portion, wherein the characters are printed on the flag portion, a first input means for inputting a diameter of the cylindrical member, and a first setting means for setting a character size at which printing is to be performed by the printing means and a length of the winding margin portion on the basis of the diameter of the cylindrical member as input by the first input means.

According to another exemplary aspect of the invention, there is provided a tape creating apparatus that includes a printing means that prints characters on a label tape that includes a winding margin portion that is wound around a periphery of a cylindrical member and a flag portion that is uniformly formed with the winding margin portion, wherein characters are printed on the flag portion, a first input means for inputting a diameter of the cylindrical member, a second input means for inputting a length of the flag portion, a third input means for inputting a character size at which printing is to be performed by the printing means, and a first setting means for setting a length of the winding margin portion such that the length of the winding margin portion is set to be longer than a peripheral length of the cylindrical member on the basis of the diameter of the cylindrical member as input by the first input means, the length of the flag portion as input by the second input means, and the character size as input by the third input means.

According to another exemplary aspect of the invention, there is provided a tape creating apparatus that includes a printing means that prints characters on a label tape that includes a winding margin portion that is wound around a periphery of a cylindrical member and a flag portion that is uniformly formed with the winding margin portion, wherein the characters are printed on the flag portion, a first input means for inputting a diameter of the cylindrical member, a second input means for inputting a length of the flag portion, a third input means for inputting a character size at which printing is to be performed by the printing means, and a first setting means for setting a length of the winding margin portion on the basis of the diameter of the cylindrical member as input by the first input means, the length of the flag portion as input by the second input means, and the character size as input by the third input means.

According to another exemplary aspect of the invention, there is provided a tape creating apparatus that includes a printing means that prints characters on a label tape that includes a winding margin portion that is wound around a periphery of a cylindrical member and a flag portion that is uniformly formed with the winding margin portion, wherein the characters are printed on the flag portion, a first input means for inputting a diameter of the cylindrical member, a second input means for inputting a number of the cylindrical members, a third input means for inputting a length of the flag portion, a fourth input means for inputting a character size at which printing is to be performed by the printing means, and a first setting means for setting a length of the winding margin portion such that the length of the winding margin portion becomes longer than a peripheral length of the cylindrical member on the basis of the diameter of the cylindrical member as input by the first input means, the number of the cylindrical members as input by the second input means, the length of the flag portion as input by the third input means, and the character size as input by the fourth input means.

According to another exemplary aspect of the invention, there is provided a tape creating apparatus that includes a printing device that prints characters on a label tape that includes a winding margin portion that is wound around a periphery of a cylindrical member and a flag portion that is uniformly formed with the winding margin portion, wherein characters are printed on the flag portion, an input device that inputs a diameter of the cylindrical member, and a controller that sets a length of the flag portion and a length of the winding margin portion on the basis of the diameter of the cylindrical member as input by the input device.

According to another exemplary aspect of the invention, there is provided a tape creating apparatus that includes a printing device that prints characters on a label tape that includes a winding margin portion that is wound around a periphery of a cylindrical member and a flag portion that is uniformly formed with the winding margin portion, wherein the characters are printed on the flag portion, an input device that inputs a diameter of the cylindrical member, and a controller that sets a character size at which printing is to be performed by the printing device and a length of the winding margin portion on the basis of the diameter of the cylindrical member as input by the input device.

According to another exemplary aspect of the invention, there is provided a tape creating apparatus that includes a printing device that prints characters on a label tape that includes a winding margin portion that is wound around a periphery of a cylindrical member and a flag portion that is uniformly formed with the winding margin portion, wherein the characters are printed on the flag portion, an input device that inputs a diameter of the cylindrical member, a length of the flag portion, and a character size at which printing is to be performed by the printing device, and a controller that sets a length of the winding margin portion such that the length of the winding margin portion becomes longer than a peripheral length of the cylindrical member on the basis of the diameter of the cylindrical member, the length of the flag portion, and the character size as input by the input device.

According to another exemplary aspect of the invention, there is provided a tape creating apparatus that includes a printing device that prints characters on a label tape that includes a winding margin portion that is wound around a periphery of a cylindrical member and a flag portion that is uniformly formed with the winding margin portion, wherein the characters are printed on the flag portion, an input device that inputs a diameter of the cylindrical member, a length of the flag portion, and a character size at which printing is to be performed by the printing device, and a controller that sets a length of the winding margin portion on the basis of the diameter of the cylindrical member, the length of the flag portion, and the character size as input by the input device.

According to another exemplary aspect of the invention, there is provided a tape creating apparatus that includes a printing device that prints characters on a label tape that includes a winding margin portion that is wound around a periphery of a cylindrical member and a flag portion that is uniformly formed with the winding margin portion, wherein characters are printed on the flag portion, an input device that inputs a diameter of the cylindrical member, a number of the cylindrical members, a length of the flag portion, and a character size at which printing is to be performed by the printing device, and a controller that sets a length of the winding margin portion such that the length of the winding margin portion becomes longer than a peripheral length of the cylindrical portion on the basis of the diameter of the cylindrical member, the number of the cylindrical members, the length of the flag portion, and the character size as input by the input device.

According to another exemplary aspect of the invention, there is provided a method of controlling a tape creating apparatus that creates a label tape including a winding margin portion that is wound around a periphery of a cylindrical member and a flag portion that is uniformly formed with the winding margin portion, the method comprising the steps of performing printing of characters to the flag portion, and setting, upon input of a diameter of the cylindrical member, a length of the flag portion and a length of the winding margin portion on the basis of the input diameter of the cylindrical member.

According to another exemplary aspect of the invention, there is provided a method of controlling a tape creating apparatus that creates a label tape including a winding margin portion that is wound around a periphery of a cylindrical member and a flag portion that is uniformly formed with the winding margin portion, the method comprising the steps of performing printing of characters to the flag portion, and setting, upon input of a diameter of the cylindrical member, a character size at which printing is to be performed and a length of the winding margin portion.

BRIEF DESCRIPTION OF THE DRAWINGS

Exemplary embodiments of the invention will be described below in detail with reference to the accompanying drawings in which:

FIG. 10 is a numeric table related to lengths of a flag portion according to an exemplary embodiment of the invention;

FIG. 11 is a numeric table related to lengths of a flag portion according to an exemplary embodiment of the invention;

FIG. 12 is a numeric table related to character sizes according to an exemplary embodiment of the invention;

FIG. 13 is a numeric table related to character sizes according to an exemplary embodiment of the invention;

FIG. 14 is an equation related to lengths of a winding margin portion according to an exemplary embodiment of the invention;

FIG. 15 is a numeric table related to lengths of a winding margin portion according to an exemplary embodiment of the invention;

DETAILED DESCRIPTION OF PREFERRED EMBODIMENTS

Figure 1:
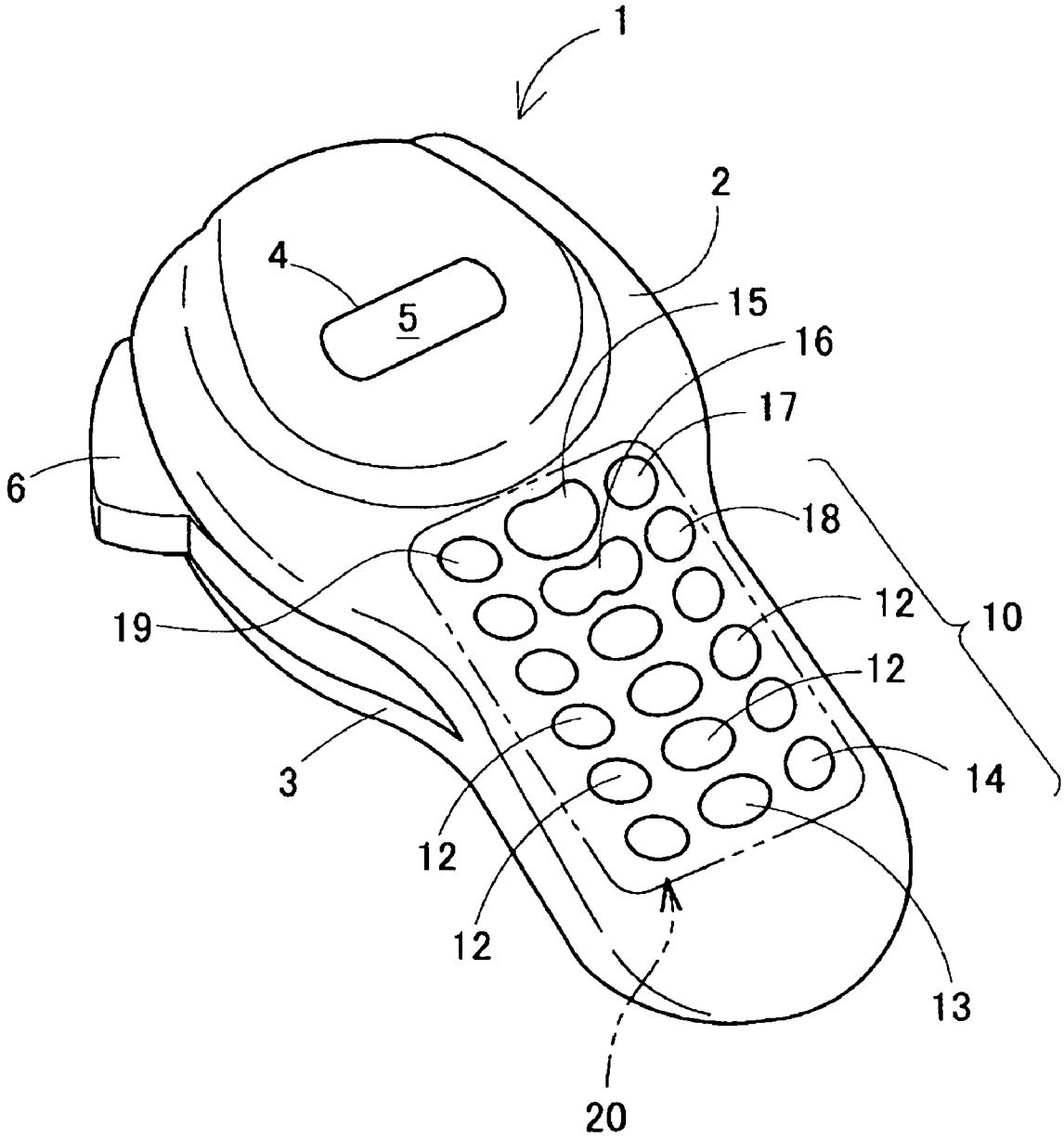
FIG. 1 is a schematic perspective view of an external appearance of the tape creating apparatus according to an exemplary embodiment of the invention.

The tape creating apparatus according to the invention will now be explained in detail on the basis of an embodiment in which the invention has been embodied while referring to the drawings. A schematic structure of the tape creating apparatus according to the embodiment will first be explained on the basis of FIGS. 1 and 2. FIG. 1 is a schematic perspective view of an external appearance of the tape creating apparatus according to an exemplary embodiment of the invention, and FIG. 2 is a schematic sectional view of the tape creating apparatus according to an exemplary embodiment of the invention.

Figure 2:
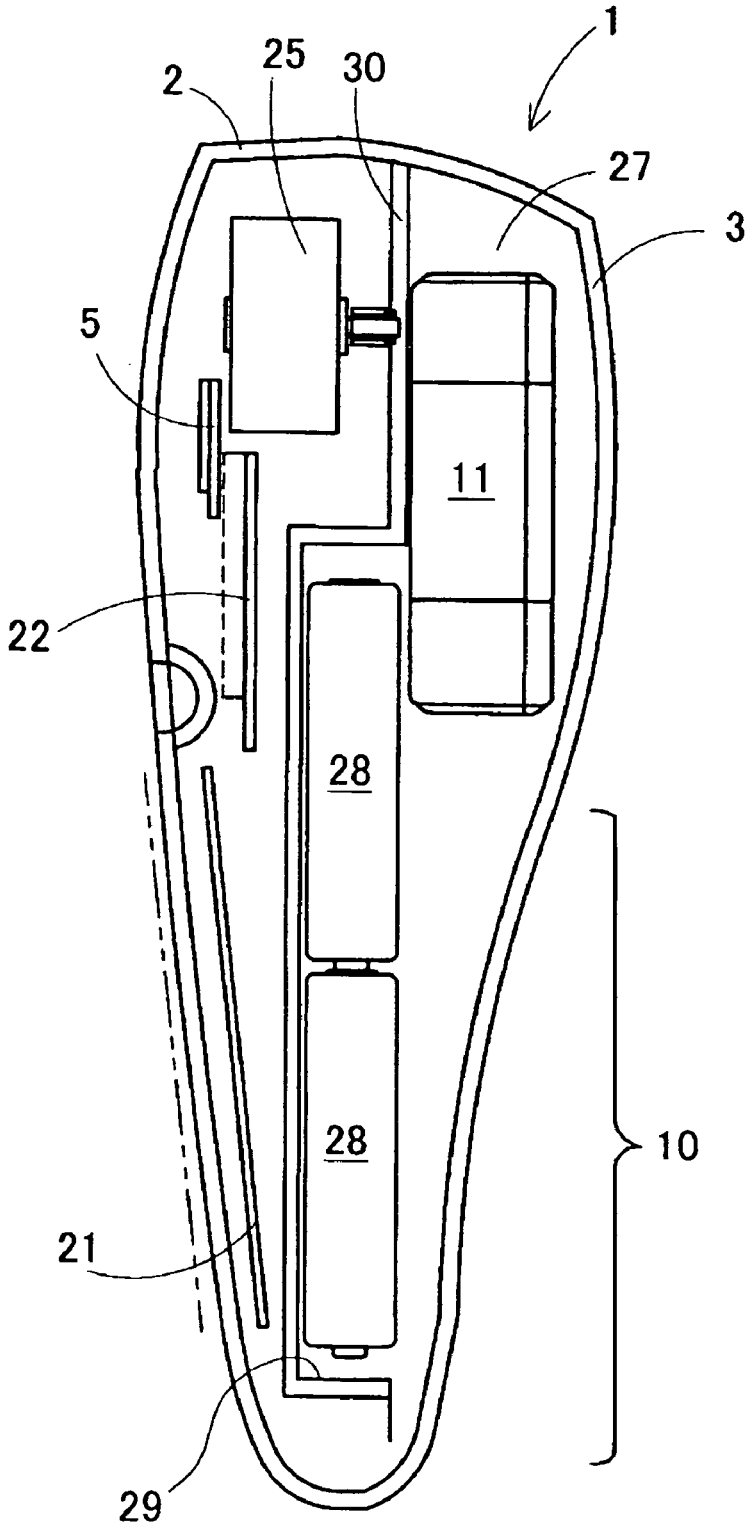
FIG. 2 is a schematic sectional view of the tape creating apparatus according to an exemplary embodiment of the invention.

As illustrated in FIGS. 1 and 2, the tape creating apparatus 1 is comprised of a main body 2 made of synthetic resin, and a rear cover 3 made of synthetic a resin. The rear cover 3 is attached in a freely attachable/detachable manner so as to cover the entire rear surface portion of the main body 2 (surface opposite to a surface that opposes a user when the tape creating apparatus 1 is being used). A portion that corresponds to substantially the upper half side in the longitudinal direction of the main body 2 is formed to be somewhat round when seen from the horizontal. A horizontally long window portion 4 is piercingly formed in right and left directions at a substantially central portion of the upper surface thereof and a liquid crystal display 5 is provided downward of the window portion 4. A cutter lever 6 is provided at a side surface portion on the left of the liquid crystal display 5 of the main body 2. By pushing the cutter lever 6 inward by using one's thumb or similar, printing tape 8 (see FIG. 3) that has been printed and discharged through a tape discharging slot 7 (see FIG. 3) that is formed at an upper end portion can be cut by a cutting blade 9 (see FIG. 3) that will be described later.

A horizontal width dimension of a portion that corresponds to substantially the lower half side in the longitudinal direction of the main body 2 is formed to be somewhat narrower than a horizontal width dimension of the upper portion thereof. The corner portions on right and left side surfaces of the lower half-side are also formed to be round to comprise a grip portion 10. Corner portions on right and left side surfaces of a portion of the rear cover 3 that corresponds to the grip portion 10 are also formed to be round. The rear cover 3 that is attached to the main body 2 is formed such that a thickness dimension of the tape creating apparatus 1 becomes gently smaller from a portion that opposes the tape cassette 11 to the grip portion 10, and a thickness dimension of the grip portion 10 is formed to be smaller than a thickness dimension of a portion in which the tape cassette 11 is accommodated. As such, the grip portion 10 is arranged so that the operator can easily grasp the tape creating apparatus 1.

A keyboard 20 comprising, among others, character input keys 12 through which texts comprised of document data are created, a space key 13 that inputs spaces, a switch key 14 that switches between upper-case letters and lower-case letters of the alphabet each time the key is pressed, a print key 15 that instructs printing of the texts, a cursor key 16 that moves the cursor to the right and left on the liquid crystal display device 5 that displays characters such as letters, a power button 17 that switches the power ON and OFF, a return key 18 that instructs character selection and others, and a flag printing setting key 19 that switches from normal printing to flag printing and that performs setting of flag printing is disposed on the surface of the grip portion 10. The keys are also formed of soft rubber or similar material.

The character input keys 12 are arranged such that input may be performed upon switching between a plurality of alphanumeric characters each time the keys are pressed. For instance, when characters of "a, b, c, 2" are printed on an upper surface portion of a character input key 12, the characters of "a", "b", "c" and "2" are sequentially displayed at a cursor portion on the liquid crystal display 5 each time this character input key 12 is pressed. By pressing the return key 18, the input character is determined. Each time the switch key 14 is pressed, the lower-case alphabet "a" and the upper-case alphabet "A", the lower-case alphabet "b" and the upper-case alphabet "B", and the lower-case alphabet "c" and the upper-case alphabet "C" are displayed in a switching manner. By pressing the return key 18, the character is determined.

As illustrated in FIG. 2, a substrate 21 is provided onto which the keyboard 20 is provided on an upper surface portion of the substrate 21. In particular, the respective character input keys 12, the space key 13, the switch key 14, the print key 15, the cursor key 16, the power button 17, the return key 18 and the flag printing setting key 19 are disposed on the front surface portion of the substance 21 that is located on a rear surface portion of the grip portion 10 of the main body 2. A control substrate 22 on which a control circuit portion is arranged is provided on a rear surface portion between the grip portion 10 and the liquid crystal display 5 of the main body 2. On an upper side of the control substrate 22 in the longitudinal direction of the main body 2 on an opposite side with respect to a thermal head 23 that is to be described later, a driving motor 25 for rotatably driving a platen roller 24 (see FIG. 3) via a gear train (not shown) is provided on a rear surface portion of the main body 2.

A cassette accommodating section 27 is formed on a rear surface of a partitioning member 30 that is made of synthetic resin. The cassette accommodating section 27 (see FIG. 3) accommodates the tape cassette 11 as will be described later. A battery accommodating section 29 is also formed on the rear surface portion of the partitioning member 30. The battery accommodating section 29 serially accommodates (see FIG. 3) dry batteries 28 by twos. Screws 31 extend to an aperture of the rear surface side of the main body 2 at which the respective substrates 21, 22, the liquid crystal display 5 or the driving motor 25 etc. are formed (see FIG. 3).

Figure 3:
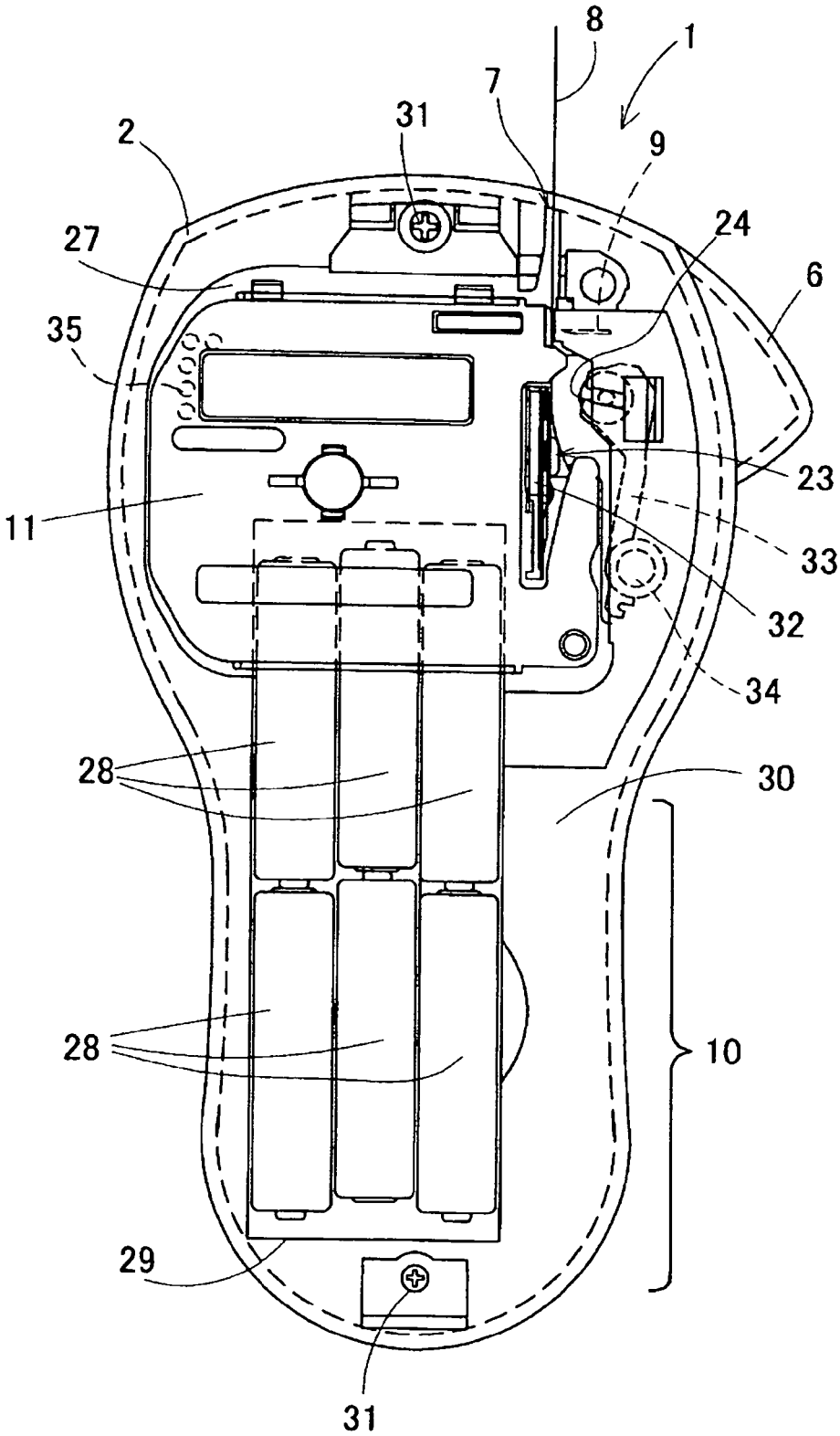
FIG. 3 is a schematic bottom view illustrating a condition in which a tape cassette is mounted upon detaching a rear cover that is mounted to the tape creating apparatus according to an exemplary embodiment of the invention.

The structure of the partitioning member 30 will now be explained on the basis of FIG. 3. FIG. 3 is a schematic bottom view illustrating a condition in which the tape cassette 11 is mounted upon detaching a rear cover that is mounted to the tape creating apparatus 1 according to an exemplary embodiment of the invention.

As illustrated in FIG. 3, a cassette accommodating section 27, which is formed to have a substantially rectangular horizontal section that is almost identical to the outer shape of the tape cassette 11 and which is formed to be bulge rearward of a depth dimension that is almost identical to a thickness dimension of the tape cassette 11, is provided at a portion on an upper half side in the longitudinal direction of the partitioning member 30. A plurality of heating elements (not shown) is provided in an aligned manner on a bottom surface portion proximate of an end edge portion of the cassette accommodating section 27 on the cutter lever 6 side. A sheet-like thermal head mounting portion 32 to which a thermal head 23 that performs printing of characters or the like onto the printing tape 8 via a print ribbon (not shown) is provided in a right-angled outward direction to face along the longitudinal direction of the main body 2. A side surface portion of the cassette accommodating section 27 opposing the thermal head 23 is notched while a platen holder 33, which is provided to be rotating about a rotating shaft 34 at a lower end portion thereof, is provided on a rear surface portion of the partitioning member 30 that opposes the notched portion.

A plurality (5 in the present embodiment) of detection switches 35 is further provided on a bottom portion of the cassette accommodating section 27, wherein the detection switches 35 are selectively switched ON and OFF via a plurality (5 in the present embodiment) of concave and convex portions (not shown) formed on a bottom surface of the tape cassette 11 when the tape cassette 11 is set to the cassette accommodating section 27.

The printing tape 8 and the print ribbon are incorporated in the tape cassette 11, and the type of tape cassette 11 used in the tape creating apparatus 1 according to the present embodiment is distinguished by combinations of the incorporated printing tape 8 and the print ribbon. Among these, there are six types, namely 6 mm, 9 mm, 12 mm, 18 mm, 24 mm and 36 mm, for the tape width of the printing tape 8 and two types of tapes, that is, a laminated tape 40 and a receptor tape 41.

Figure 4:
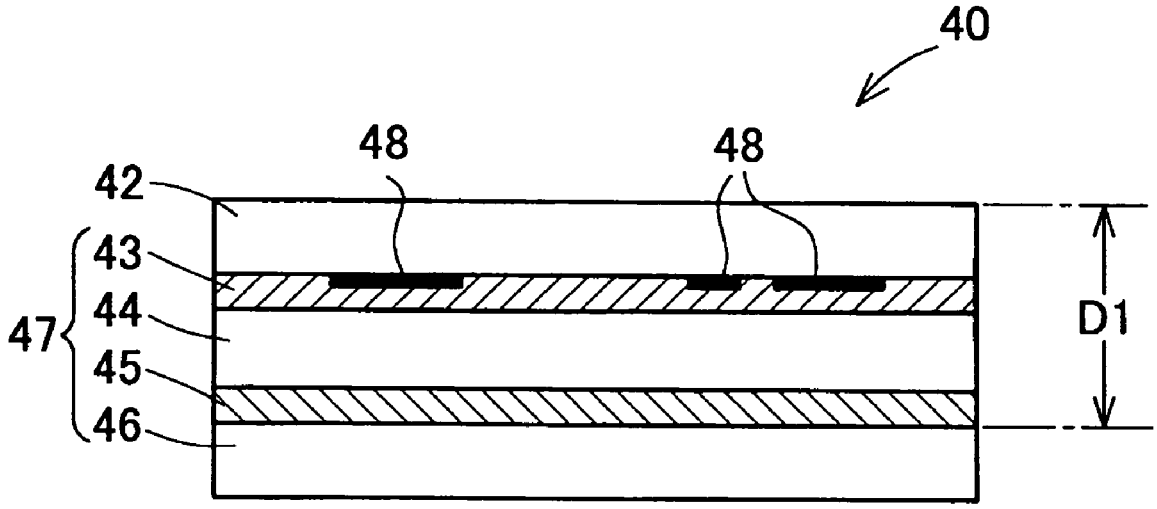
FIG. 4 is a diagrammic view illustrating a section of a laminated tape according to an exemplary embodiment of the invention.
Figure 5:
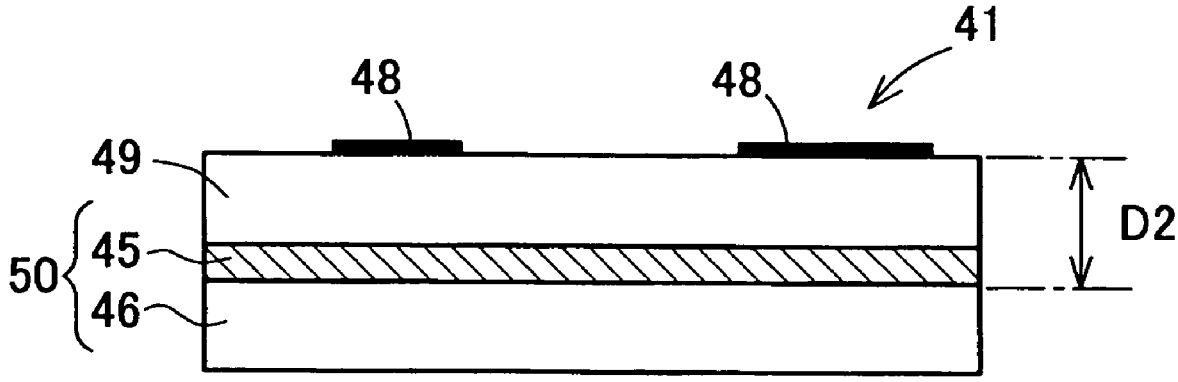
FIG. 5 is a diagrammic view illustrating a section of a receptor tape according to an exemplary embodiment of the invention.

The structures of the laminated tape 40 and the receptor tape 41 will now be explained by using FIGS. 4 and 5. FIG. 4 is a sectional view illustrating the structure of the laminated tape in diagrammic style, and FIG. 5 is a sectional view illustrating the structure of the receptor tape in diagrammic style.

The laminated tape 40 is comprised of a transparent tape 42, a transparent adhesive layer 43, a base material 44, an adhesive layer 45 and a separator 46. When performing printing, printing is performed onto the transparent tape 42 through the thermal head 23 and the print ribbon, and a double-sided adhesive tape 47 comprised of the transparent adhesive layer 43, the base material 44, the adhesive layer 45 and the separator 46 is backed to the printed transparent tape 42 whereupon the tape is discharged through the tape discharging slot 7. Printed ink is then disposed between the transparent tape 42 and the transparent adhesive layer 43.

The laminated tape 40 of the above structure is then adhered onto an object after peeling off the separator 46 prior to use. At this time, a tape thickness D1 from the transparent tape 42 up to the adhesive layer 45 is 0.1 mm.

On the other hand, the receptor tape 41 is comprised of a tape to be printed 49, an adhesive layer 45 and a separator 46. When performing printing, printing is performed onto the tape to be printed 49 through the thermal head 23 and the print ribbon, and a double-sided adhesive tape 50 comprised by the adhesive layer 45 and the separator 46 is backed to the tape to be printed 49 that has undergone printing whereupon the tape is discharged through the tape discharging slot 7. Printed ink 48 is then adhering to the surface of the tape to be printed 49.

The receptor tape 41 of the above structure is then adhered onto an object after peeling off the separator 46 prior to use. At this time, a tape thickness D2 from the tape to be printed 49 up to the adhesive layer 45 is 0.07 mm.

Accordingly, 12 (6 by 2) types of combinations may exist based on the combinations of the tape width and the type of printing tape 8. Here, a combination of the tape width and the type of printing tape 8 incorporated in the tape cassette 11 is detected in the following manner.

As described above, concave and convex portions are selectively formed on the bottom surface of the tape cassette 11 for specifying a combination of the tape width and the type of printing tape 8 incorporated in the tape cassette 11, wherein such concave and convex portions selectively switch the detection switches 35 ON or OFF when the tape cassette 11 is set in the cassette accommodating section 27. In this manner, switch signal patterns in which such ON and OFF switch signals are combined are obtained from the respective detection switches 35.

On the other hand, a ROM 66 that is to be described later stores therein tape cassette detection tables in which combinations of the type of tape width and the type of the print ribbon of the printing tape 8 incorporated in the tape cassette 11 and in which combinations of switch signal patterns that are obtained from the respective detection switches 35 are mutually related.

By mutually referring to the switch signal patterns output from the respective detection switches 35 and the tape cassette detection tables when the tape cassette 11 is set to the cassette accommodating section 27, the combination of the tape width and the type of the printing tape 8 that is incorporated in the table cassette 11 will be detected.

Figure 6:
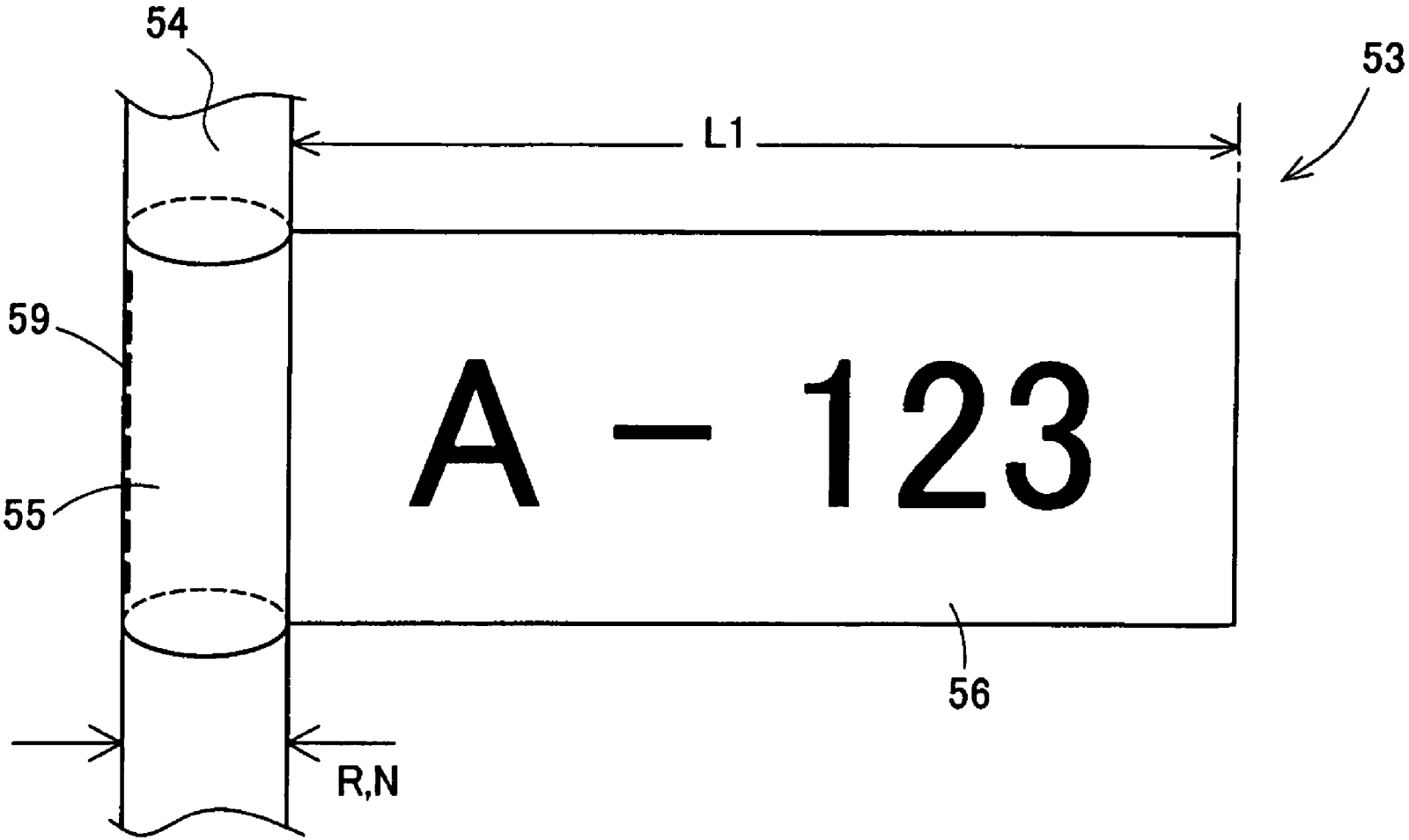
FIG. 6 is a front view illustrating a condition after adhering a label tape to a cord according to an exemplary embodiment of the invention.
Figure 7:
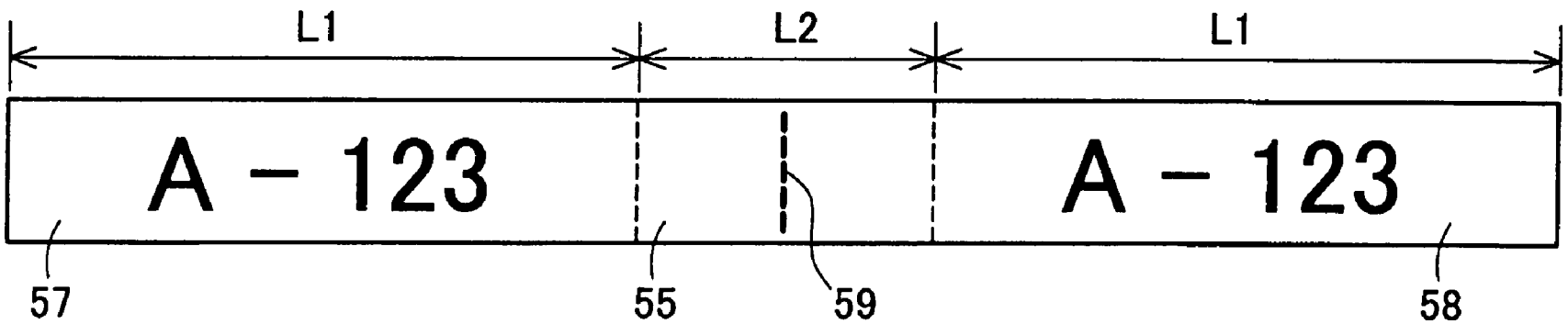
FIG. 7 is a front view illustrating a condition prior to adhering the label tape to a cord according to an exemplary embodiment of the invention.

The overall structure of a label tape 53 that is created by using the above tape creating apparatus 1 will now be explained by using FIGS. 6 and 7. FIG. 6 is a front view of the label tape in a condition in which it is used upon being wound around a cord. FIG. 7 is a front view of the label tape prior to being wound around the cord.

The label tape 53 is basically comprised of a winding margin portion 55 that is wound around a periphery of a cord 54 and a flag portion 56 that is uniformly formed with the winding margin portion 55 and onto which characters indicating, for instance, a type of the cord are printed. When creating the label tape 53, a first flag portion 57 and a second flag portion 58 are located on both sides while pinching the winding margin portion 55 between, wherein the same characters are printed at the same size on the first flag portion 57 and the second flag portion 58, respectively. A reference line 59 in the form of a broken line is printed in a width direction of the tape at a central position of the winding margin portion 55. At this time, the length of the first flag portion 57 and that of the second flag portion 58 are both L1, and the length of the winding margin portion 55 is made to be L2. In this respect, respective values of L1 and L2 are automatically set to be suitable values depending on the diameter R of the cord 54 and the number of cords N when a plurality of cords 54 is to be tied. Such a setting mechanism will be explained later in details. As shown in FIG. 6, the cord 54 has a circular cross-section. As should be appreciated, the cord 54 can have any cross-section. As also should be appreciated, the cord 54 can be any structure currently available or later developed that can be identified or distinguished by using the label tape 53.

The thus created label tape is adhered to the cord 54 by abutting the cord 54 against the winding margin portion 55 and by forming the flag portion 56 by mutually adhering the first flag portion 57 and the second flag portion 58. Further, adhesion shall be performed by winding the tape around the periphery of one or a plurality of cords 54 by using the reference line 59 that is printed on the central position of the winding margin portion 55 as a reference. It is thus possible to create a label tape 53 that can be easily and reliably attached to various types of cords 54. As for the label attached to the cord 54, characters indicating, for instance, the type of the cord can be easily viewed from all directions so that it is possible to easily confirm the type of cord.

Figure 8:
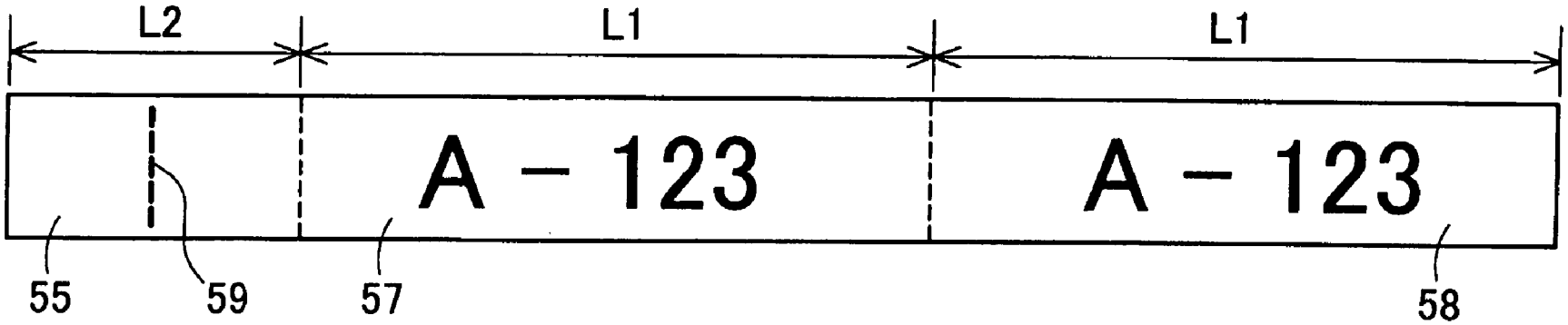
FIG. 8 is a front view illustrating a condition prior to adhering the label tape to a cord according to another exemplary embodiment of the invention.

As should be appreciated, other examples for creating the label tape 53 other than a type in which the first flag portion 57 and the second flag portion 58 are located on both sides of the winding margin portion 55 are available. For example, it is possible to create the tape as illustrated in FIG. 8 in which the winding margin portion 55, the first flag portion 57 and the second flag portion 58 are located in this order. It is also possible to locate them vice versa in the order of the first flag portion 57, the second flag portion 58 and the winding margin portion 55.

Figure 9:
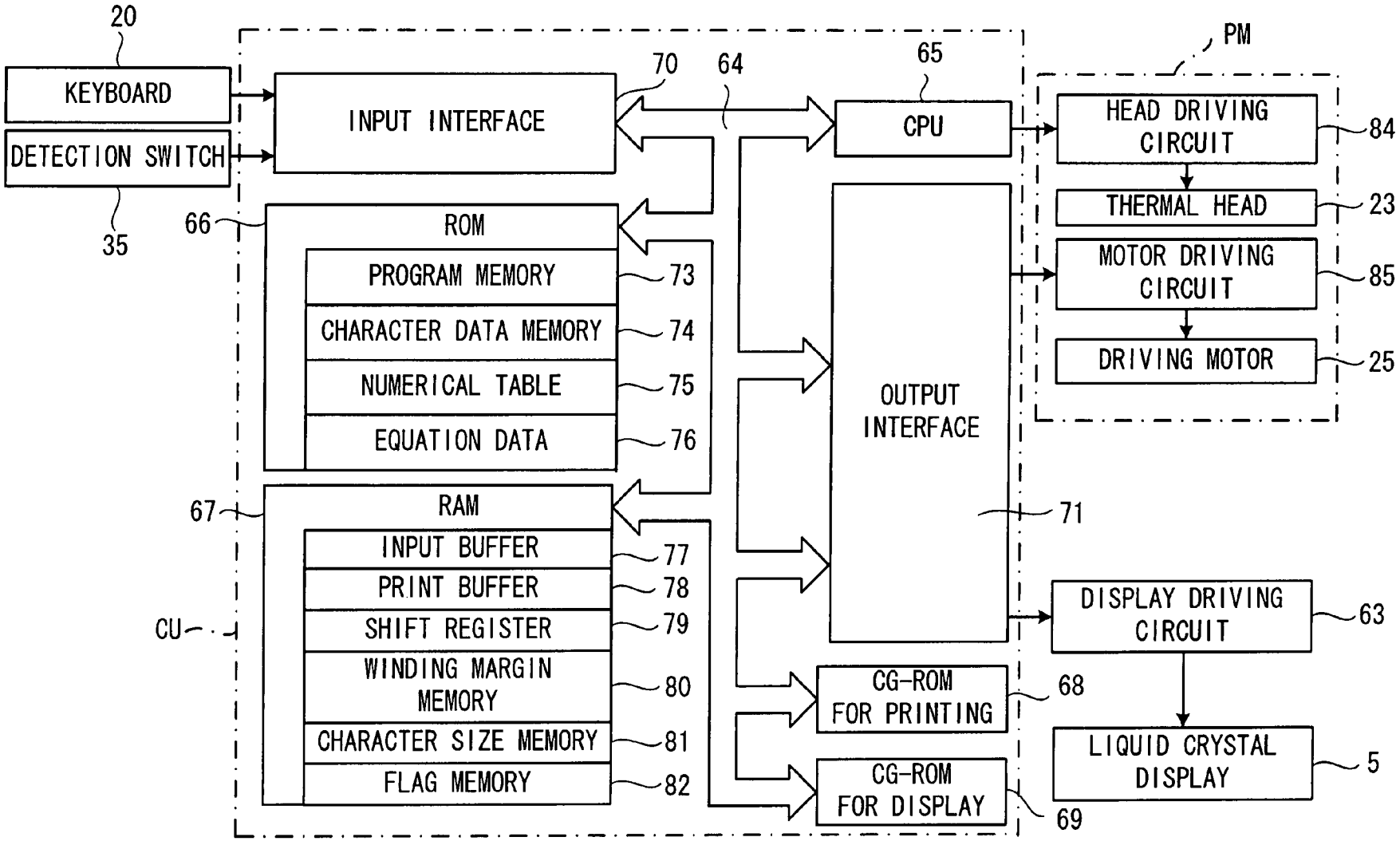
FIG. 9 is a control block diagram of the tape creating apparatus according to an exemplary embodiment of the invention.

A control system including a control unit CU that drives and controls a printing mechanism PM and the liquid crystal display 5 will next be explained. FIG. 9 is a control block diagram of the tape creating apparatus according to an exemplary embodiment of the invention.

As illustrated in FIG. 9, there are connected to the control unit CU the keyboard 20, the printing mechanism PM, the liquid crystal display 5 via a display driving circuit 63, and the detection switches 35 that detect the type of the tape cassette 11, that is, the tape width and the type of printing tape.

The control unit CU includes a CPU 65 that is mutually connected thereto through a bus 64, a ROM 66, a RAM 67, a CG-ROM for printing 68, a CG-ROM for display 69 for displaying to the liquid crystal display 5, an input interface 70, and an output interface 71. The keyboard 20 and the detecting switches 35 are respectively connected to the input interface 70.

The ROM 66 is for storing various programs, and includes a program memory 73 storing therein a basic control program, a print control program (both of which will be described later), and other programs necessary for controlling the tape creating apparatus 1. The CPU 65 performs various calculations on the basis of the various programs stored in the ROM 66.

The ROM 66 stores therein outline data for defining outlines of respective characters for each of the plurality of characters, such as letters, are stored in a character data memory 74 upon being classified by respective typefaces (gothic type typeface, Mincho type typeface, etc.) to correspond to cord data. The ROM 66 also stores various numerical tables 75 in which respective values related to lengths of winding margins required for winding tapes around a periphery of cords, sizes of characters to be printed, and lengths of flag portions that correspond to printing portions are arranged as tables in correspondence with the above-mentioned diameters R of cords 54 and the number N of cords 54. The ROM 66 also stores equation data 76 obtained by calculating respective values.

The RAM 67 is arranged to temporally store respective results of calculations that have been calculated by the CPU 65, and the RAM 67 is provided with various memories. Here, the RAM 67 is provided with an input buffer 77 that stores input data, a print buffer 78 that stores data for printing, a shift register 79, and other various counters and registers. A winding margin memory 80 stores data of the winding margin portions 55 that are input in correspondence with the diameters R of the cords 54. A character size memory 81 and a flag memory 82 are for storing character size data and data related to flag portions 56 that are input in correspondence with the diameters R of the cords 54 and the number N of cords.

In the CG-ROM 68 for printing, a plurality of dot pattern data of characters that comprise objects of printing is stored while being correlated to cord data. The CG-ROM 69 for displaying stores a plurality of dot pattern data for displaying characters that comprise objects of printing while being correlated to cord data.

Further, there are connected to the input interface 71 a head driving circuit 84 that drives the thermal head 23 constituting the printing mechanism PM, a motor driving circuit 85 that drives the driving motor 25 for rotating and driving the platen roller 24 that also constitutes the printing mechanism PM, and the display driving circuit 63.

The numerical table 75 and the equation data 76 will now be explained on the basis of FIGS. 10 to 15. First, table 1 correlates diameters R of the cords 54 with lengths L1 of the flag portions 56 when the number N of cords 54, which are objects to which the label tapes 53 are adhered, is one. In this respect, the number N of cords and the diameters R of cords are input by the operator in flag setting processes as will be described later, wherein an input unit for the number N of cords is at least one, and an input unit for the diameters R of the cords is at least 1 mm (see FIGS. 18 and 19).

As can be seen in FIG. 10, when, for instance, the diameter R is larger than 4 mm but not more than 6 mm, 40 mm is selected as the length of the flag portion 56. Since a maximum value for the lengths L1 of the flag portions 56 is 160 mm, when the diameter R is larger than 12 mm, 160 mm is selected as the length of the flag portion 56.

Next, table 2 correlates the number N of cords 54 and the diameters R of cords 54 with lengths L1 of the flag portions 56. Lengths L1 of the flag portions 56 are indicated in which N-number of cords 54 of diameters R are tied and then wound by the label tape 53.

As illustrated in FIG. 11, when, for instance, the number N of cords is three and the diameter R is larger than 4 mm but not more than 6 mm, 80 mm is selected as the length of the flag portion 56.

Table 3 correlates the diameters R of the cords 54, the character sizes S to be printed onto the flag portions 56, and the numbers of printed dots in the case the number N of cords 54 is one.

As illustrated in FIG. 12, when, for instance, the diameter R is larger than 4 mm but not more than 6 mm, 3 is selected as the character size S, and printing is performed on the flag portion 56 at a number of printed dots of 32 by 32 dots. Since a maximum value for the character size S is 7, 7 is selected as the character size when the diameter R is larger than 12 mm, and printing is performed on the flag portion 56 at a number of printed dots of 128 by 128 dots.

Next, table 4 correlates the number N and the diameters R of cords 54 and the character sizes S to be printed onto the flag portions 56. Character sizes S are indicated in which N-number of cords 54 of diameters R are tied and then wound by the label tape 53.

As illustrated in FIG. 13, when, for instance, the number N of cords is three and the diameter R is larger than 4 mm but not more than 6 mm, 5 is selected as the character size S and printing is performed onto the flag portion 56 at a number of printed dots of 64 by 64 dots (see FIG. 12 for relationship between character sizes S and numbers of printed dots).

Next, equation 1 correlates the diameters R of the cords 54 and the lengths L2 of the winding margin portions 55 when the number N of cords 54 is one.

As illustrated in FIG. 14, the length L2 of the winding margin portion 55 becomes a value that is obtained by adding twice the thickness D of the tape to the diameter R of the cord and multiplying the same by the circular constant π. In this respect, the thickness D of the tape is a thickness of the tape after adhering the tape to an object but not including the thickness of the separator 46.

With this structure, the length L2 of the winding margin portion 55 will become longer than the peripheral length of the cord 54. In a condition in which the tape has once been wound around the cord, the length L2 of the winding margin portion 55 is not less than the peripheral length of the cord including the wound tape. Accordingly, the length of the winding margin portion 55 will not run short but may be adhered when a tape is to be adhered onto a cord 54 that has already been adhered with a label tape 53. Moreover, when an error has been caused between the actual diameter of the cord and the diameter R of the cord that has been input by the operator and the diameter of the actual cord is larger, it is possible to prevent a case in which the length of the winding margin portion 55 runs short. Further, when adhering the label tape 53 on the cord 54 and it should happen that the tape is adhered obliquely with respect to the cord 54 or wrinkles are generated at the tape, there is no fear that the length of the winding margin 55 runs short.

In this respect, in the present embodiment, a value of a thickness of either one of the two types of tapes used, namely, the laminated tape 40 or the receptor tape 41, with the larger thickness of the tape is used as the thickness D of the tape. With this structure, the value of the thickness D of the tape does not need to be changed for each tape being used, and processes can be easily performed.

As explained above, the tape thickness D1 of the laminated tape 40 from the transparent tape 42 to the adhesive layer 45 is 0.1 mm, and the tape thickness D2 of the receptor tape 41 from the tape to be printed 49 to the adhesive layer 45 is 0.07 mm (see FIGS. 4 and 5). The present embodiment is thus arranged in that the thickness D of the tape is a fixed value of 0.1 mm.

The length L2 of the winding margin portion may be set to a value that is even longer than the value as defined above by equation 1 that is obtained by adding twice the thickness D of the tape to the diameter R of the cord and multiplying the same by the circular constant π.

Figure 16:
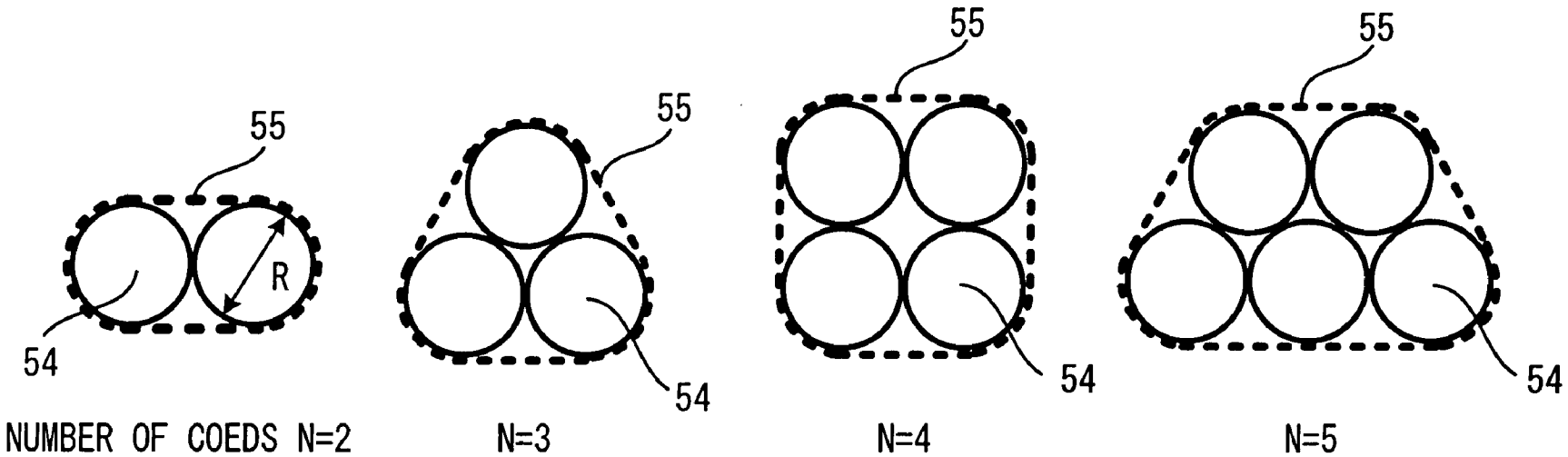
FIG. 16 is a diagrammic view illustrating a winding margin portion that ties a plurality of cords.

Next, table 5 correlates the number N and the diameters R of cords 54 and the lengths L2 of the winding margin portions 55. As illustrated in FIG. 16, the winding margin portion 55 when the number N of cords is a multiple number is wound around the periphery of the cords 54 in a tied condition. FIG. 16 is a diagrammic view illustrating a winding margin portion 55 in which cords 54 are tied when the number of cords is 2 to 5.

As illustrated in FIG. 15, when, for instance, the number N of cords is three and the diameter R is larger than 4 mm but not more than 6 mm, 37 mm is selected as the length L2 of the winding margin portion. The length L2 of the winding margin portion is defined to be a value that is longer than a minimum required length (36.84 mm) when three cords having a diameter R of 6 mm are tied (see FIG. 16). Accordingly, also in case an error has been caused between the actual diameter of the cord and the diameter R of the cord that has been input by the operator and the diameter of the actual cord is larger, it is possible to prevent a case in which the length of the winding margin portion 55 runs short. Further, when adhering the label tape 53 on the cords 54 and it should happen that the tape is adhered obliquely with respect to the cords 54 or wrinkles are generated at the tape, there is no fear that the length of the winding margin 55 runs short.

Figure 17:
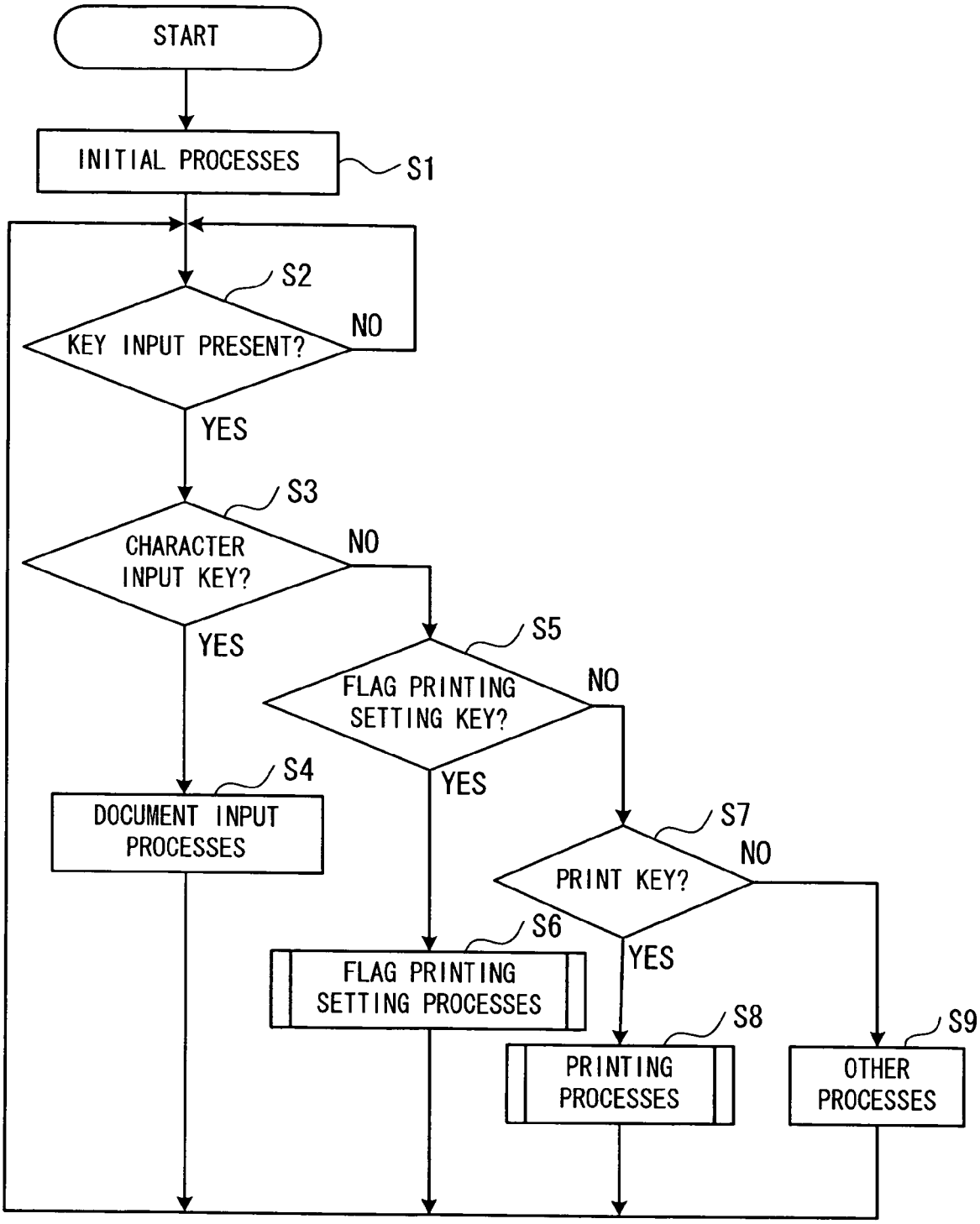
FIG. 17 is a flowchart of a basic control program of the tape creating apparatus according to an exemplary embodiment of the invention.

Operations of the tape creating apparatus 1 of the above arrangement will now be explained on the basis of FIGS. 17 to 20. FIG. 17 is a flowchart of a basic control program of the tape creating apparatus 1.

First, when the power switch is switch ON, initialization such as clearing respective memories is performed in Step (hereinafter referred to as "S") 1. After performing various initialization settings, basic control is performed.

In S2, it is determined whether any key on the keyboard 20 has been operated, and if no key has been operated (S2: NO), key operation is awaited. When a key has been operated (S2: YES), it is determined whether one of the character input keys 12 or a function key such as the flag printing setting key 19 has been operated (S3). If one of the character input keys 12 has been operated (S3: YES), the character that has been input through this character input key 12 is stored in the input buffer 77 (S4) whereupon the program returns to S2. Upon repeatedly performing the processes of S2 to S4, texts such as letters corresponding to names of cords are created, and such texts are sequentially stored in the input buffer 77.

If it is determined in S2 that a function key has been operated (S3: NO), it is further determined in S5 whether the flag printing setting key 19 has been operated. If the flag printing setting key 19 has been operated (S5: YES), the normal printing mode is changed to the flag printing mode whereupon the liquid crystal display 5 is switched to the flag printing setting display, and the program returns to S2 upon performing various setting processes (S6).

If it is determined in S5 that the flag printing setting key 19 has not been operated (S5: NO), it is determined whether the print key 15 has been operated (S7). If the print key 15 has been operated (S7: YES), printing processes corresponding to the set mode (normal printing mode or flag printing mode) are performed (S8). If no printing is to be performed (S7: NO), other processes corresponding to an input key, for instance, input, deletion or editing of document data is performed (S9), and the program then returns to S2.

Figure 18:
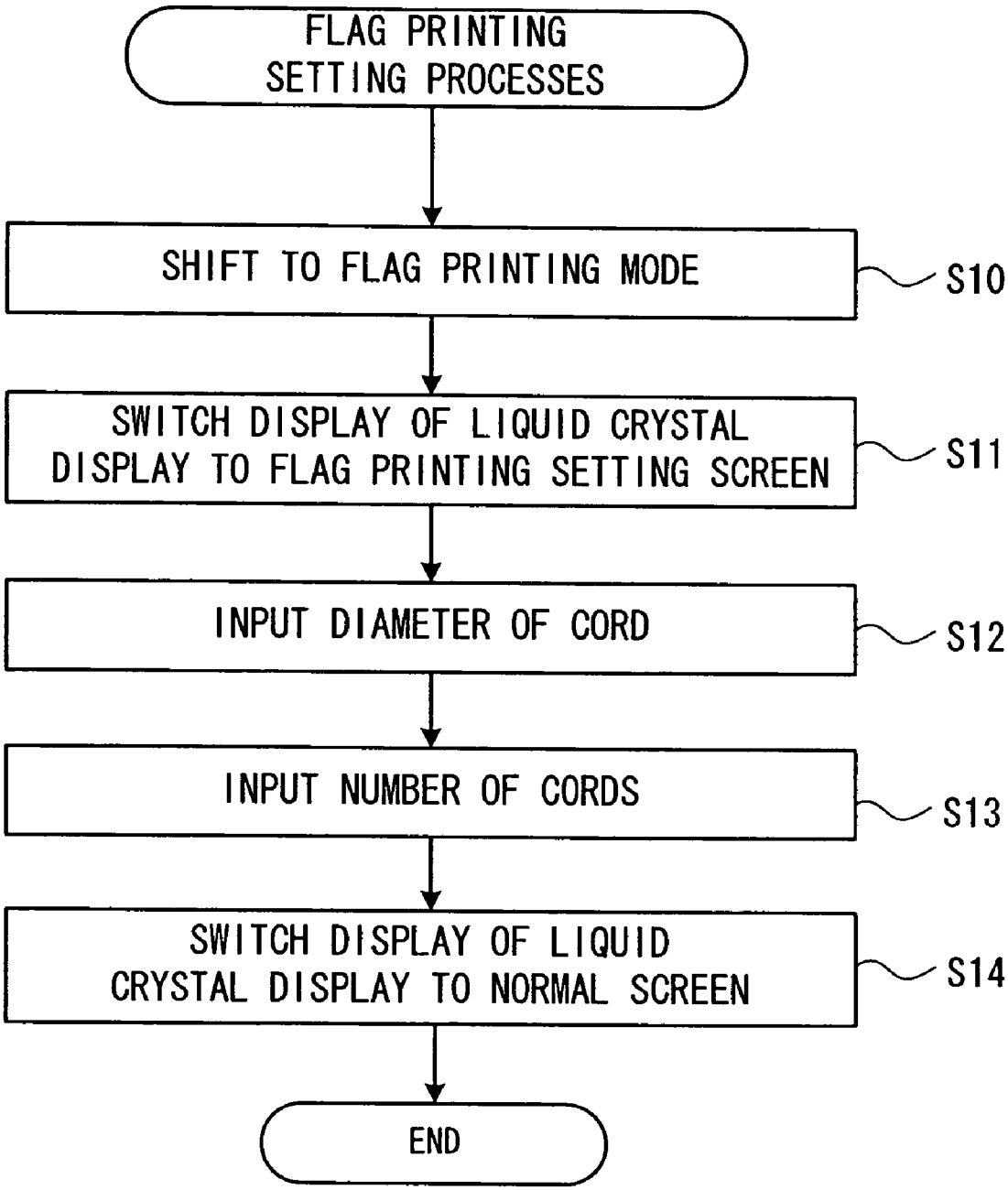
FIG. 18 is a flowchart of a flag setting program of the tape creating apparatus according to an exemplary embodiment of the invention.

Next, the flag printing setting processes of S6 will now be explained with reference to FIG. 18. FIG. 18 is a flowchart of a flag setting program.

Figure 19:
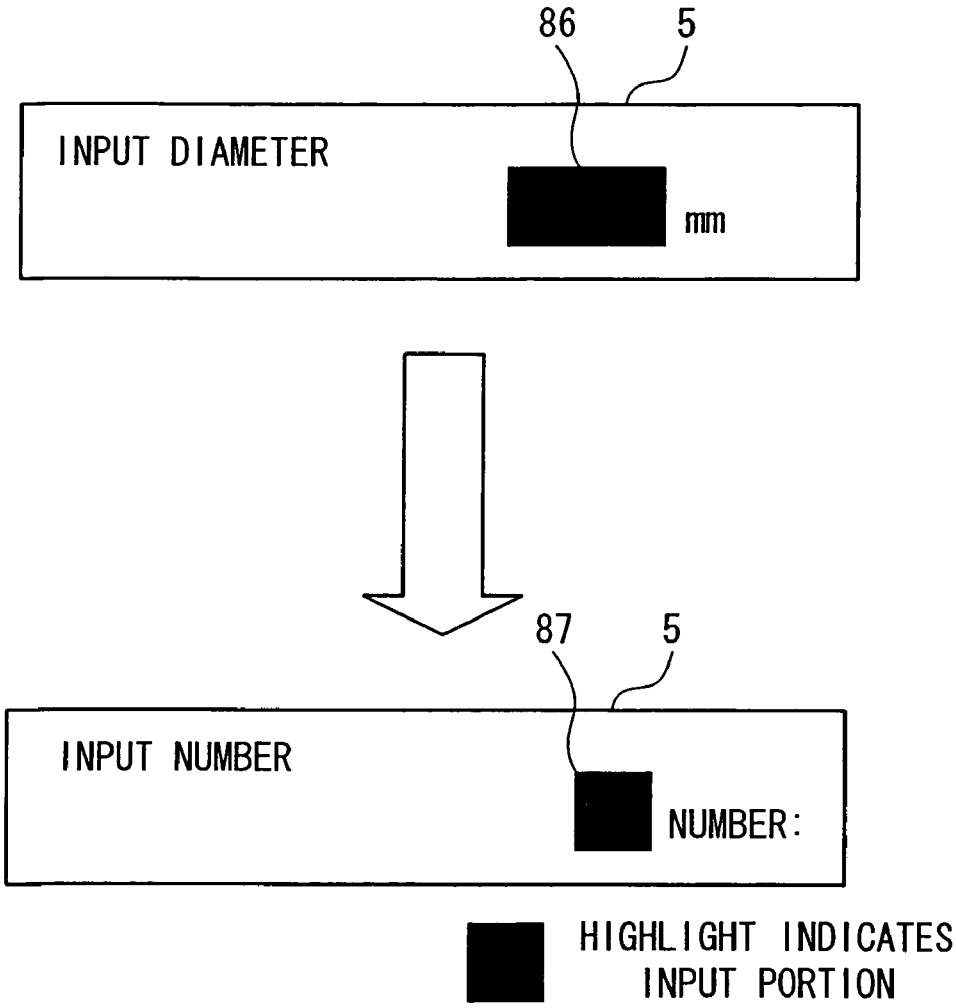
FIG. 19 is an explanatory view illustrating an input screen that is displayed on a liquid crystal display.

The tape creating apparatus 1 is first shifted from the normal printing mode to the flag printing mode in S10. Thereafter, the liquid crystal display 5 is switched to the flag printing setting display screen (S11) to be a screen through which a diameter of a cord, which is to be an object around which a label tape is to be wound, is input. FIG. 19 is an explanatory view illustrating respective input screens that are displayed on the liquid crystal display 5.

As illustrated in FIG. 19, an input screen through which a diameter R of a cord 54 is input is first displayed on the liquid crystal display 5, and an input portion is indicated by a highlighted portion 86. If a numerical value of the diameter is input by using the character input keys 12 with a minimum unit being 1 mm (S12), the input numerical value is displayed on the liquid crystal display 5 and is also stored in the input buffer 77. Next, an input screen through which a number N of cords is input is displayed on the liquid crystal display 5, and an input portion is indicated by a highlighted portion 87. When the number N is input by using the character input keys 12 with a minimum unit being 1 (S13), the input numerical value is similarly displayed on the liquid crystal display 5 and is stored in the input buffer 77.

The liquid crystal display 5 is then switched to the normal display screen (S14), and the flag printing setting processes are terminated.

Figure 20:
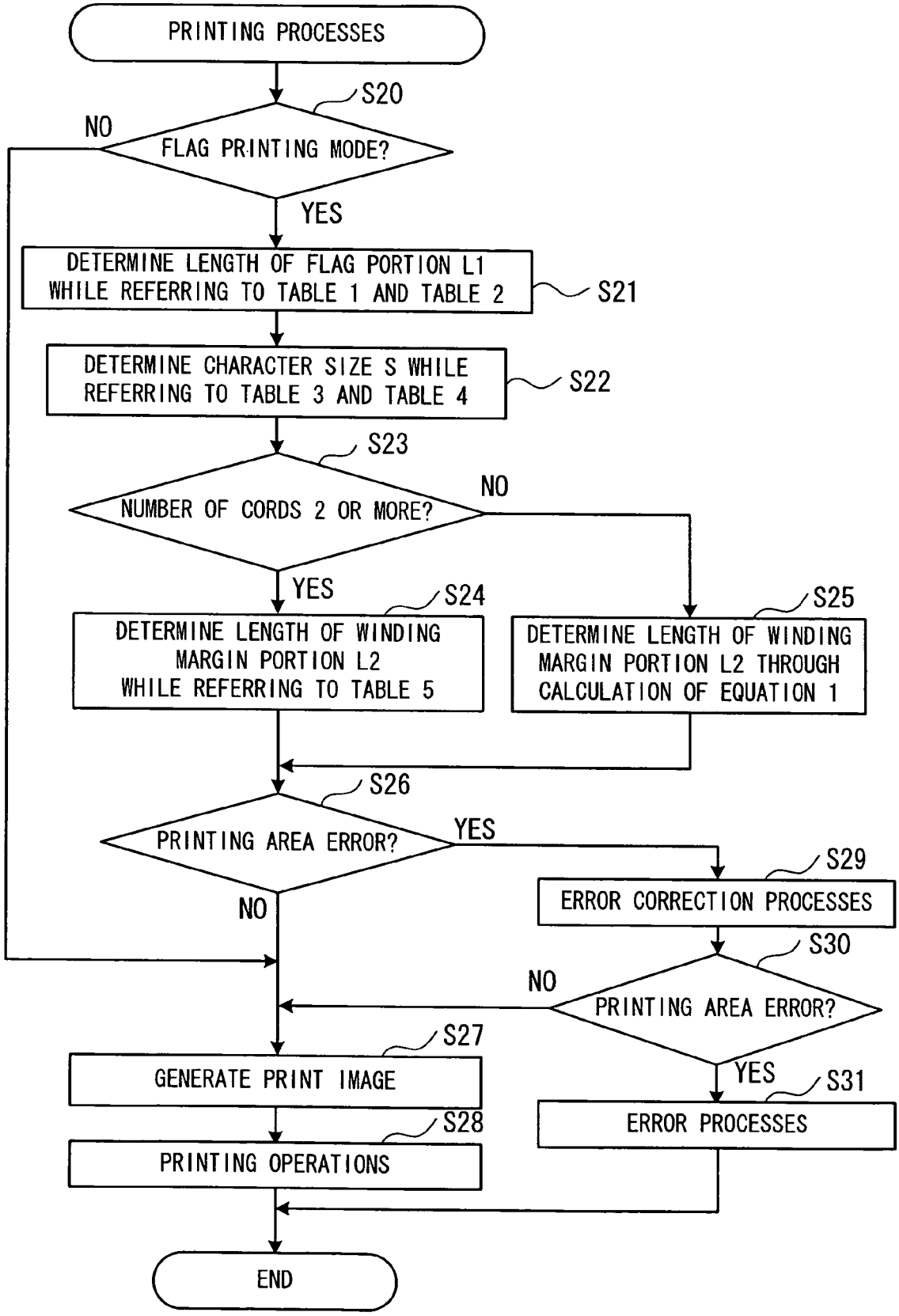
FIG. 20 is a flowchart of a print control program of the tape creating apparatus according to an exemplary embodiment of the invention.

Printing processes of S8 will now be explained with reference to FIG. 20. FIG. 20 is a flowchart of a print control program.

In S20, it is first determined whether the present printing mode of the tape creating apparatus 1 is the normal printing mode or the flag printing mode. If the mode has been shifted from the normal printing mode to the flag printing mode in S10 (S20: YES), the program proceeds to S21 for performing specific printing processes for flag printing. On the other hand, if the mode is the normal printing mode (S20: NO), the program proceeds to S27 for performing normal printing processes.

In S21, a length L1 of the flag portion 56 is selected on the basis of the diameter R and the number N of cords 54 that have been stored in the input buffer 77 in S12 and S13 by using the table 1 and the table 2 stored in the numerical tables 75 of the ROM 66 (see FIGS. 10 and 11) and stored in the flag memory 82.

In S22, a printing size S at which printing is to be performed on the flag portion 56 is similarly selected on the basis of the diameter R and the number N of cords 54 that have been stored in the input buffer 77 in S12 and S13 by using the table 3 and the table 4 stored in the numerical tables 75 of the ROM 66 (see FIGS. 12 and 13) and stored in the character size memory 81, whereupon the program proceeds to S23.

In S23, it is determined whether the number N of cords 54 that has been stored in the input buffer 77 in S13 is 2 or more. If the number is 2 or more (S23: YES), a length L2 of the winding margin portion 55 is selected on the basis the diameter R and the number N of cords 54 that have been stored in the input buffer 77 by using the table 5 stored in the numerical tables 75 of the ROM 66 (see FIG. 15) and stored in the winding margin memory 80. On the other hand, if the number of cords is one (S23: NO), the length L2 of the winding margin portion 55 is calculated on the basis the diameter R of the cord 54 that has been stored in the input buffer 77 by using the equation 1 stored in the equation table 76 of the ROM 66 (see FIG. 14), and the result is stored in the winding margin memory 80.

It is then determined for the above-described S21, S22, S24 and S25 whether print area errors occur on the basis of print data stored in the respective memories 80, 81 and 82 of the RAM 67 (S26). An example of a case in which a print area error occurs is one in which it has been determined that the characters are too big to fit into the flag portion 56 when printing of the text that has been stored in the input buffer 77 in S4 is printed onto the flag portion 56 having a length of L1 as determined in S21 at a character size S as determined in S22. A print area error is also issued when the characters printed at the character size S as determined in S22 is larger than the tape width (6 mm, 9 mm, 12 mm, 18 mm, 24 mm or 36 mm) of the tape 8 accommodated in the tape creating apparatus 1 or when a sum of twice the length L1 of the flag portion and the length L2 of the winding margin portion has exceeded a maximum tape length at which a tape can be created by the tape creating apparatus 1 (in this embodiment, 1,000 mm). In this respect, the tape width is detected by the detection switches 35.

If it is determined that no print area error will be caused (S26: NO), the dot pattern data read out from the CG-ROM for printing 33 in correspondence with document data of the text as stored in the input buffer 77 are expanded and stored in the print buffer 78 (S27). The thermal head 23 then performs printing operations in accordance with dot pattern data stored in the print buffer 78 (S28). If it has been shifted to the flag printing mode, flag printing including the winding margin portion 55, the first flag portion 57, the second flag portion 58 and the reference line 59, etc. is performed on the basis of respective data stored in the winding margin memory 80, the character size memory 81 and the flag memory 82 (see FIGS. 7 and 8).

On the other hand, if it is determined that a print area error will be generated (S26: YES), error correction processes corresponding to respective errors are performed (S29). For example, if an error has occurred due to a shortage in the width of the tape 8 or in the length L1 of the flag portion with respect to the print area, the character size S as determined in S22 is reduced to such an extent with which a printable area is achieved. If the maximum tape length at which a tape can be created by the tape creating apparatus 1 has been exceeded, the flag length L1 as determined in S21 is shortened to such an extent with which the length of the tape to be created becomes not more than the maximum tape length that can be created. The respective data of the corrected character size S and the flag portion length L1 are updated and stored in the respective memories 81 and 82.

After performing error correction processes (S29), it is again determined on the basis of the corrected data of the RAM 67 whether a print area error will be generated (S30). If it is determined that no print area error will be generated (S30: NO), the program proceeds to S27, and printing operations are performed on the basis of the corrected data.

On the other hand, if the print area error can not be eliminated through the error correction processes (S29) (S30: YES), error is indicated on the liquid crystal display 5 that no printing can be performed (S31) whereupon printing processes are terminated.

In the tape creating apparatus 1 according to the present embodiment that has been explained above in details, respective values of the lengths L1 of flag portions 56, the character sizes S, and the lengths L2 of the winding margin portions of a label tapes 53 are set (S21, S22, S24, S25) by selecting or calculating them from numerical tables 75 and equation data 76 that have been preliminarily stored in the ROM 66 on the basis of the diameters R and numbers N of cords 54 that are input during the flag printing setting processes (S6). Printing is also performed on the basis of the set values (S28) so that character sizes S, lengths L1 of flag portions and lengths L2 of winding margin portions of the label tapes 53 are set that are suitable for tying N-number of cords 54 of diameters R. As such, the operator does not need to set values for the character sizes, the lengths of flag portions and the lengths of the winding margin portions on his or her own. It is accordingly possible to create label tapes 53 that suit thicknesses and the numbers of cords 54 to be adhered to through extremely simple operations. The thinner the cords are and the smaller the number of cords 54 to be tied is, the smaller will the character sizes to be printed be and the shorter will the lengths of the flag portions be so that discrimination of the type of the cords will become easy.

Further, since the lengths of the winding margin portions L2 is set to be longer than the peripheral lengths that are required for winding and tying the cords 54, there will be no fear that the lengths L2 of the winding margin portions run short also in the presence of an error between the diameters R of the cords as input during the flag printing setting processes (S6) and the actual cord diameters. Also in case wrinkles or flexures are generated in the tapes when wound around the cords 54 or when tapes are obliquely wound around the cords 54, the lengths L2 of the winding margin portions are sufficiently secured so that the tapes may be adhered. Also when tapes are newly adhered onto label tapes 53 that have already been wound around cords 54 in an overlapping manner, it is possible to prevent cases in which the lengths L2 of the winding margin portions run short.

In this respect, the invention is not to be limited by the above embodiment alone, and it is definitely possible to perform various improvements and variations without deviating from the gist of the invention.

For instance, while the tape thickness D that is selected in equation 1 of the present embodiment has been defined to be the thickness D1 of the laminated tape 40, which is the thickest of the types of tapes to be used, it is also possible to read the tape thickness D on the basis of respective types of tapes as stored in the ROM 66 when the type of the tape has been detected by the detection switches 35 and to perform calculation by using equation 1.

The length L2 of the winding margin portion shall be larger than a value in which the diameter R of the cord is multiplied by the circular constant π, and it may be defined to be longer by a specified ratio irrespective of the thickness of the tape D.

In the illustrated embodiment, a controller (CPU 65) preferably is implemented using a suitably programmed general purpose computer, e.g., a microprocessor, microcontroller or other processor device (CPU or MPU). It will be appreciated by those skilled in the art, that the controller also can be implemented as a single special purpose integrated circuit (e.g., ASIC) having a main or central processor section for overall, system-level control, and separate sections dedicated to performing various different specific computations, functions and other processes under control of the central processor section. The controller also can be implemented using a plurality of separate dedicated or programmable integrated or other electronic circuits or devices (e.g., hardwired electronic or logic circuits such as discrete element circuits, or programmable logic devices such as PLDs, PLAs, PALs or the like). The controller also can be implemented using a suitably programmed general purpose computer in conjunction with one or more peripheral (e.g., integrated circuit) data and signal processing devices. In general, any device or assembly of devices on which a finite state machine capable of implementing the described procedures can be used as the controller of the invention.

In accordance with various exemplary aspects of the invention, when creating a label tape including a winding margin portion that is wound around a periphery of a cord, and a flag portion that is uniformly formed with the winding margin portion for indicating a type of the cord or similar by using the tape creating apparatus, the tape creating apparatus sets the length of the flag portion and the length of the winding margin portion on the basis of the input diameter of the cord so that length of the flag portion and length of the winding margin portion that suits the diameter of the cord are set while the operator does not need to set the length value of flag portions and the winding margin portion on his or her own. The tape creating apparatus also sets the character size to be printed and the length of the winding margin portion on the basis of the diameter of the cord input to the apparatus so that a character size and a length of the winding margin portion that suit the diameter of the cord are set while the operator does not need to set a character size or a length of the flag portion on his or her own. It is accordingly possible to create a label tape that corresponds to the diameter of the cord and that is easily visible through simple operations, and it is further possible to create a label tape with which discrimination of types of cords may be more easily performed when the tape is used by being wound since the length of the flag portion and the character size are changed in accordance with a diameter of the cord.

According to another exemplary aspect of the invention, the tape creating apparatus further sets a length of the flag portion. In this case, the tape creating apparatus sets the character size to be printed, the length of the flag portion, and the length of the winding margin portion on the basis of the input diameter of the cord so that a character size, a length of the flag portion, and a length of the winding margin portion that suit the diameter of the cord are set while the operator does not need to set a character size, a length of the flag portion, or a length of the winding margin portion on his or her own.

In accordance with another exemplary aspect of the invention, the tape creating apparatus sets the length of the flag portion and the length of the winding margin portion on the basis of the input diameter of the cord and the input number of cords so that when creating a label tape that indicates types of cords or similar by being wound around a plurality of cords in a tied condition, a length of the flag portion and a length of the winding margin portion that suit the cords in a tied condition are set. It is accordingly possible to create a label tape that corresponds to a thickness of the cords in a tied condition and that is easily visible through simple operations, and it is further possible to create a label tape with which discrimination of types of tied cords when they are tied may be more easily performed since the length of the flag portion is changed in accordance with the number of cords and the diameter thereof.

In accordance with another exemplary aspect of the invention, the tape creating apparatus sets the character size, the length of the flag portion and the length of the winding margin portion on the basis of the input diameter of the cord and the input number of cords so that when creating a label tape that indicates types of cords or similar by being wound around a plurality of cords in a tied condition, a character size, a length of the flag portion and a length of the winding margin portion that suit the cords in a tied condition are set. It is accordingly possible to create a label tape that corresponds to a thickness of the cords in a tied condition and that is easily visible through simple operations, and it is further possible to create a label tape with which discrimination of types of tied cords when they are tied may be more easily performed since the character size and the length of the flag portion are changed in accordance with the number of cords and the diameter thereof.

In accordance with another exemplary aspect of the invention, since the length of the winding margin portion is set to be longer than the peripheral length of the cord, the length of the winding margin portion will not run short but may be adhered also in the presence of an error between the input diameter of the cord and the actual diameter of the cord. Also upon occurrence of wrinkles or flexures at the tape when wound around the cords, or also when the tape has been erroneously wound obliquely with respect to the cord, the length of the winding margin portion will not run short. Also when a new tape is adhered onto a cord to overlap a label tape that has already been adhered thereto, the length of the winding margin portion will not run short, either.

In accordance with another exemplary aspect of the invention, since the length of the winding margin portion is set to be a value that is not less than a value obtained by adding twice the thickness of the cord to the diameter of the cord and multiplying the same by the circular constant, when a tape is to be adhered to overlap a tape that has already been adhered to the cord, a length that exceeds the peripheral length of the cord including the tape that is already wound around is defined to be the winding margin portion of the label tape to be newly wound, the length of the winding portion will not run short so that the tape may be reliably adhered.

While the invention has been described with reference to exemplary embodiments, it is to be understood that the invention is not limited to the exemplary embodiments or constructions. While the various elements of the exemplary embodiments are shown in various combinations and configurations, which are exemplary, other combinations and configurations, including more, less or only a single element, are also within the spirit and scope of the invention.

What is claimed is:

1. A tape creating apparatus, comprising:

a printing device that prints characters on a label tape that includes a winding margin portion that is wound around a periphery of a cylindrical member and a flag portion that is uniformly formed with the winding margin portion, wherein characters are printed on the flag portion and a reference line is printed at a central position of the winding margin portion;

an input device that inputs a diameter of the cylindrical member and a number of the cylindrical members; and a controller that sets a length of the flag portion and a length of the winding margin portion on the basis of the diameter of the cylindrical member and the number of the cylindrical members as input by the input device, and that sets a character size of the characters that are to be printed by the printing device, wherein:

the length of the flag portion is set with a first table correlating the diameter of the cylindrical member and the number of the cylindrical members with the length of the flag portion, the length of the winding margin portion is set with a second table correlating the diameter of the cylindrical member and the number of the cylindrical members, and the character size is set with a third table correlating the diameter of the cylindrical member and the number of cylindrical members with the character size.

2. A non-transitory computer-readable recording medium storing a tape creating apparatus control program for controlling a tape creating apparatus that creates a label tape including a winding margin portion that is wound around a periphery of a cylindrical member and a flag portion that is uniformly formed with the winding margin portion, the program comprising instructions for:

performing printing of characters to the flag portion and a reference line at a central position of the winding margin portion; and setting, upon input of a diameter of the cylindrical member and a number of the cylindrical members, a length of the flag portion and a length of the winding margin portion on the basis of the input diameter of the cylindrical member and the input number of the cylindrical members, and setting a character size of the characters that are to be printed, wherein:

the length of the flag portion is set with a first table correlating the diameter of the cylindrical member and the number of the cylindrical members with the length of the flag portion, the length of the winding margin portion is set with a second table correlating the diameter of the cylindrical member and the number of the cylindrical members, and the character size is set with a third table correlating the diameter of the cylindrical member and the number of the cylindrical members with the character size.

3. A tape creating apparatus, comprising:

a printing device that prints characters on a label tape that includes a winding margin portion that is wound around a periphery of a cylindrical member and a flag portion that is uniformly formed with the winding margin portion, wherein characters are printed on the flag portion and a reference line is printed at a central position of the winding margin portion;

an input device that inputs a diameter of the cylindrical member; and a controller that sets a length of the flag portion and a length of the winding margin portion on the basis of the diameter of the cylindrical member as input by the input device, and that sets a character size of the characters that are to be printed by the printing device, wherein:

the length of the flag portion is set with a first table correlating the diameter of the cylindrical member with the length of the flag portion, the length of the winding margin portion is set with an equation correlating to the diameter of the cylindrical member, and the character size is set with a second table correlating the diameter of the cylindrical member with the character size.

4. A non-transitory computer-readable recording medium storing a tape creating apparatus control program for controlling a tape creating apparatus that creates a label tape including a winding margin portion that is wound around a periphery of a cylindrical member and a flag portion that is uniformly formed with the winding margin portion, the program comprising instructions for:

performing printing of characters to the flag portion and a reference line at a central position of the winding margin portion; and setting, upon input of a diameter of the cylindrical member, a length of the flag portion and a length of the winding margin portion on the basis of the input diameter of the cylindrical member, and setting a character size of the characters that are to be printed, wherein:

the length of the flag portion is set with a first table correlating the diameter of the cylindrical member with the length of the flag portion, and the length of the winding margin portion is set with an equation correlating to the diameter of the cylindrical member, and the character size is set with a second table correlating the diameter of the cylindrical member with the character size.

5. The tape creating apparatus according to claim 1, wherein the winding margin portion is located between the first flag portion and the second flag portion.

6. The tape creating apparatus according to claim 1, wherein the label tape is arranged in the order of the winding margin portion, the first flag portion and the second flag portion.

7. The tape creating apparatus according to claim 1, wherein the label tape is arranged in the order of the first flag portion, the second flag portion and the winding margin portion.

8. The tape creating apparatus according to claim 3, wherein the winding margin portion is located between the first flag portion and the second flag portion.

9. The tape creating apparatus according to claim 3, wherein the label tape is arranged in the order of the winding margin portion, the first flag portion and the second flag portion.

10. The tape creating apparatus according to claim 3, wherein the label tape is arranged in the order of the first flag portion, the second flag portion and the winding margin portion.

11. The non-transitory computer-readable recording medium according to claim 2, wherein the winding margin portion is located between the first flag portion and the second flag portion.

12. The non-transitory computer-readable recording medium according to claim 2, wherein the label tape is arranged in the order of the winding margin portion, the first flag portion and the second flag portion.

13. The non-transitory computer-readable recording medium according to claim 2, wherein the label tape is arranged in the order of the first flag portion, the second flag portion and the winding margin portion.

14. The non-transitory computer-readable recording medium according to claim 4, wherein the winding margin portion is located between the first flag portion and the second flag portion.

15. The non-transitory computer-readable recording medium according to claim 4, wherein the label tape is arranged in the order of the winding margin portion, the first flag portion and the second flag portion.

16. The non-transitory computer-readable recording medium according to claim 4, wherein the label tape is arranged in the order of the first flag portion, the second flag portion and the winding margin portion.

* * * * *